United States Patent [19]

Musgrave

[11] 3,950,878

[45] Apr. 20, 1976

[54] SUPPRESSIVE BALLISTIC CUTTERS

[76] Inventor: Daniel D. Musgrave, 8201 Caraway St., Cabin John, Md. 20731

[22] Filed: Dec. 27, 1974

[21] Appl. No.: 536,749

[52] U.S. Cl. ..... 42/90
[51] Int. Cl.[2] ..... F41C 27/00
[58] Field of Search ..... 42/90, 1 MH, 1 F; 89/14 D

[56] References Cited

UNITED STATES PATENTS

| | | | |
|---|---|---|---|
| 655,577 | 8/1900 | Pell et al. | 42/90 |
| 1,211,779 | 1/1917 | Steinmetz | 42/90 |
| 2,957,175 | 10/1960 | Henning et al. | 42/1 MH |
| 3,500,955 | 3/1970 | Werbell | 89/140 |
| 3,837,107 | 9/1974 | Swaim et al. | 42/1 F |
| 3,879,878 | 4/1975 | Musgrave | 42/90 |
| B418,302 | 1/1975 | Musgrave | 42/90 |
| R28,146 | 9/1974 | Musgrave | 42/90 |

*Primary Examiner*—Charles T. Jordan

[57] ABSTRACT

A ballistic cutter is mounted at the muzzle of a firearm to permit severing a strand of obstacle material by discharging a bullet. The sound of the discharge is muffled by a sound suppressor at the muzzle, or by using a silent cartridge in the firearm.

2 Claims, 5 Drawing Figures

SUPPRESSIVE BALLISTIC CUTTERS

The capability of cutting obstacle materials by the individual soldier is now required by all first-class military forces. The newer obstacle materials, such as barbed metallic tape, are especially difficult to cut with hand-operated cutters. Ballistic cutters are effective in cutting such difficult materials but under some conditions the accompanying noise is unacceptable. The present invention contemplates reducing the ballistic noise to a low level. The mechanical sound of cutting will still remain, but the overall noise signature will be significantly suppressed.

The utility of this invention is not limited to cutting obstacle materials, nor to use by military forces. It will be useful for cutting various types of materials covertly, either by military or by non-military personnel. Furthermore, when the cutter is not used for cutting purposes the sound suppressor can perform its usual function of muffling the discharge of a bullet. It should be pointed out that the term suppressor is used in place of the older term silencer, as better describing the effect of such a device on a firearm which discharges bullets at a velocity greater than that of sound.

The principal object of this invention is to provide a ballistic cutter having associated means to suppress the muzzle blast of a firearm.

Another object is to provide a ballistic cutter for use with silent cartridges.

These and other objects of the present invention will be apparent upon reference to the following specification, taken in connection with the accompanying drawings, wherein.

Figure 1:
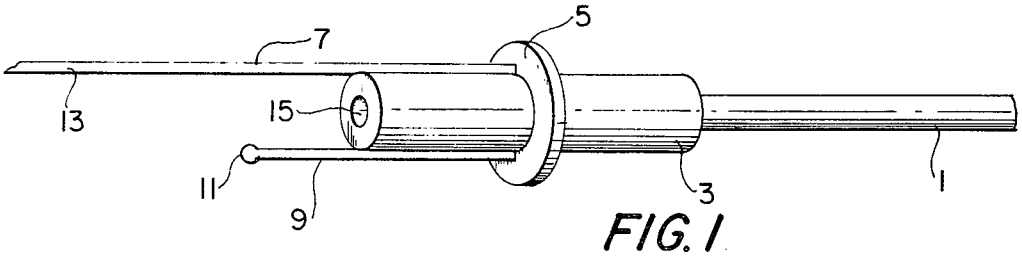
FIG. 1 is a perspective view of an embodiment of this invention mounted on the muzzle of a firearm.

Referring now to the drawings in detail, FIG. 1 shows the front or muzzle portion 1 of the barrel of a firearm having mounted thereon a sound suppressor 3. As various sound suppressors are well known in the art, it will not be necessary to describe the internal construction of the suppressor here. Fixed on the suppressor in any convenient manner is shield 5. The shield is intended to arrest any particles from the cutting operation which may be thrown to the rear, toward the user.

Also fixed to the suppressor in any convenient manner is a pair of windlassing lugs 7 and 9. Lug 9 terminates in a ball 11 which serves as a detent when material to be cut is engaged with this lug. Lug 7 is extended forward to form a bayonet, the point of which is shown at 13. Projectiles fired from barrel 1 pass through the suppressor and exit via hole 15 at the front.

Cutting is accomplished by engaging a strand of obstacle or other material between the lugs and then rotating the firearm around its longitudinal axis. This will tension the strand and align a portion of it with hole 15. A projectile discharged through barrel 1 will strike and sever the obstacle material.

The suppressor can muffle a considerable portion of the muzzle blast caused by the release of ballistic gases to the atmosphere. The impact of the bullet on the obstacle material will necessarily make some sound. The sound made by the bullet thereafter will depend on its velocity and its aerodynamic form. The typical military cartridge has greater muzzle energy output than is required for the cutting process and it fires its projectile at a velocity at which it generates considerable noise in flight. It would therefore be advantageous to use cartridges loaded for a lower velocity both to reduce impact velocity and thereby avoid projectile deformation, and to reduce flight velocity. However, standard cartridges can be used for cutting, and the suppressor will reduce the cumulative sound effect of the cutting operation, with either standard, or reduced-velocity cartridges.

Figure 2:
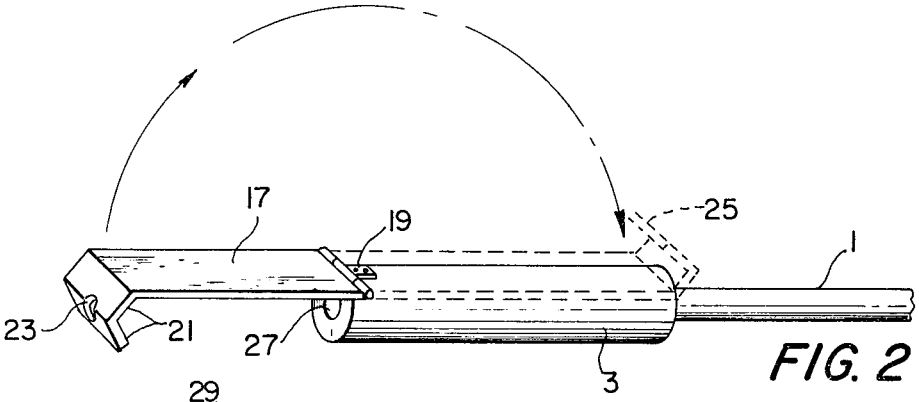
FIG. 2 is a perspective view of another embodiment of this invention.

FIG. 2 shows the muzzle portion 1 of the barrel of a firearm having mounted thereon a sound suppressor 3. Fixed to suppressor 3 in any convenient manner is hinge 19 which serves as a pivot for a plate 17 which extends forward, in front of the suppressor. The forward portion of the plate is bent downward to form a hook 21, having a hole 23 at its apex. The parts are so dimensioned that the apex of hook 21 will intersect the trajectory of a projectile emerging from hole 27 in the suppressor, after being discharged from the firearm via barrel 1.

When not required for cutting, the plate can be pivoted to a storage position as indicated by the broken lines 25 and the curved arrows. Some type of simple mechanical detent (not shown) must be provided to retain the plate in either position.

Cutting is accomplished with the plate forward as in FIG. 2. Material to be cut is engaged by hook 21 and the firearm is drawn away from the material, thus tending to align the material with hole 23. A projectile is then discharged from the firearm via barrel 1 and suppressor 3. Emerging from hole 27 it strikes and severs the material, and passes out through hole 23.

Fragments from the cutting operation which may be thrown upward will be intercepted by plate 17. If this is not sufficient for safety of the user, a shield such as is described hereinafter for FIG. 3 can be used.

Figure 3:
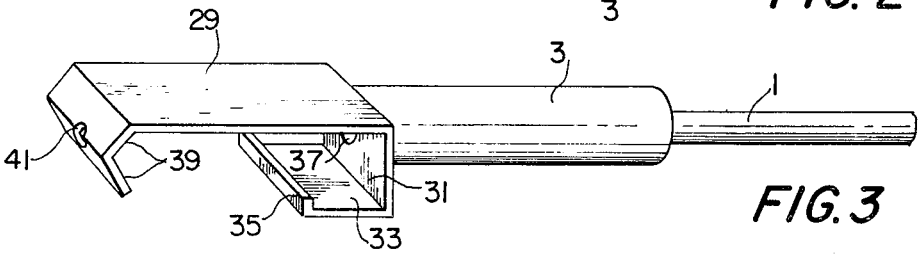
FIG. 3 is a perspective view of another embodiment of this invention.

FIG. 3 shows the muzzle portion 1 of the barrel of a firearm having mounted thereon a sound suppressor 3. Fixed to the front face of the suppressor by any convenient method is shield 31 which can deflect debris thrown rearward by the cutting operation. From the lower part of the shield a windlass plate 33 extends forward, terminating in an upwardly projecting detent 35. A hole 37 in the shield is aligned with the projectile passage in the suppressor.

From the upper part of the shield another windlass plate 29 extends forward substantially parallel to plate 33, but somewhat longer. The two plates are substantially equidistant from hole 37.

At its forward end plate 29 is bent downward to form a hook 39, having a hole 41 at its apex, aligned with the trajectory of a projectile discharged from the firearm via barrel 1, the suppressor, and hole 37. The operation of cutting with the hook is similar to that already described for FIG. 2.

The arrangement shown in FIG. 3 also permits an alternative cutting method using the windlassing plates. Material to be cut is engaged between plates 29 and 33 and the firearm is rotated around its longitudinal axis to tension the material and align a portion of it with the path of a projectile discharged from the firearm, thereby severing the material. This arrangement is particularly useful for cutting unusual shapes of obstacle material. If the unusual shape cannot be aligned properly by one engagement means the user can try the alternate means without delay, by merely moving the firearm slightly.

Figure 4:
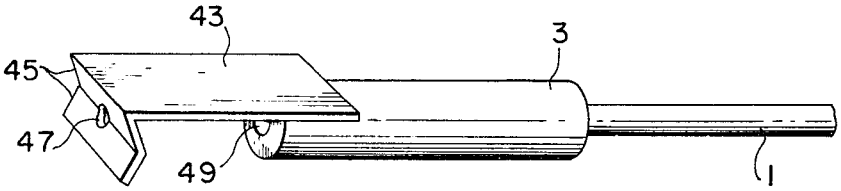
FIG. 4 is a perspective view of another embodiment of this invention.

FIG. 4 shows the muzzle portion 1 of the barrel of a firearm having mounted thereon a sound suppressor 3. Fixed to the suppressor by any convenient method is plate 43 which extends forward and is bent downward to form notch 45 having a hole 47 at its apex. Hole 47 is aligned with the path of a bullet discharged from the firearm, via hole 49 in the suppressor.

The principle of cutting is similar to that described above for FIG. 2, with exception that the notch is pushed against the material to be cut, rather than pulled against it.

Figure 5:
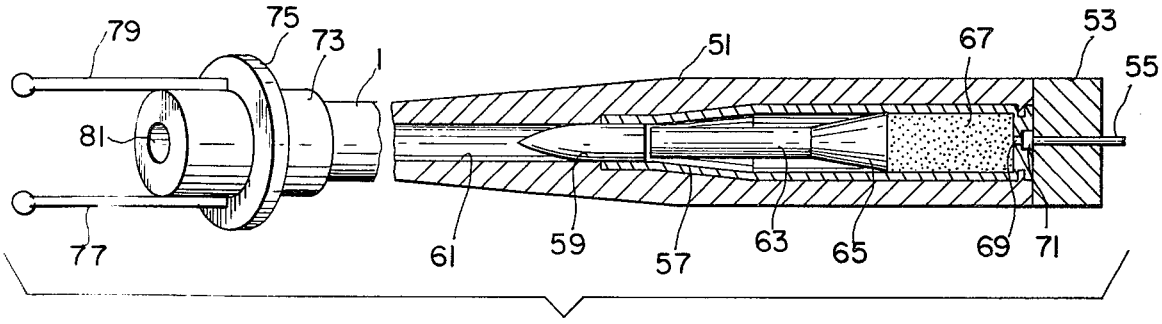
FIG. 5 is a view, partly in perspective and partly in section of a ballistic cutter and a portion of a firearm capable of discharging a silent cartridge.

FIG. 5 shows the muzzle portion 1 of the barrel of a firearm having mounted thereon a sleeve 73 to which is affixed a shield 75. Extending forward from the sleeve is a pair of windlassing lugs 77 and 79. A projectile discharged from the firearm can exit via hole 81 in the sleeve. The cutting procedure is similar to that already described for FIG. 1, except that sleeve 73 is not a sound suppressor.

In the rear portion 51 of the barrel is positioned a special type of cartridge, sometimes referred to in the press as a "tunnel" cartridge. Although cartridges on this principle were employed in tunnel fighting during the recent war, their use is by no means restricted to underground firing. For this reason the broad term "silent" cartridge has been selected for use in this specification. One type of silent cartridge is illustrated but it is not intended to limit the invention thereby. Silent cartridges differing from that shown can be employed for ballistic cutting.

The firing chamber of barrel 51 is closed at the rear by breech block 53 which accommodates firing pin 55 in a central hole, aligned with the primer 71 of the cartridge. The usual means must be provided for striking the firing pin when discharge is desired.

Positioned in the firing chamber is cartridge case 57 in which is seated projectile 59, the projectile being capable of being discharged through bore 61 in the usual manner. Interposed between the projectile and a propellant charge 67 is a piston 63 having a tapered rear portion 65. When the firing pin is struck, hot gas from primer 71 passes through vent 69 and ignites propellant 67. The piston is driven forward, accelerating the projectile which passes out of the barrel to perform the cutting operation. When the tapered portion of the piston contacts the interior tapered portion of the cartridge case, it seats there and seals the propellant gases in the cartridge case. Discharge is thus substantially noiseless. As already stated, there may be some noise generated by impact of the projectile on the material to be cut. Projectiles from silent cartridges will usually be discharged at a velocity less than that of sound.

In the arrangement shown in FIGS. 1, 2, 3, and 4 when ordinary cartridges are used, the propellant gases escape to the atmosphere via the sound suppressor. The ballistic sound effect produced will depend on the efficiency of the suppressor.

To expedite the engagement of magnetic materials such as iron wire, the element of the cutter which contacts such materials can be magnetized.

What I claim is:

1. A suppressive ballistic cutter comprising: a firearm; a sound suppressor mounted at a muzzle of said firearm and having a passage aligned with a bore of said firearm; and hook means positionally adapted for aligning material to be cut with a path of a projectile discharged from said firearm via said passage thereby severing said material, said hook means being adapted for folding away from said path when not required for cutting.

2. A suppressive ballistic cutter as set forth in claim 1 further characterized by said means for aligning material to be cut with a path of a projectile comprising both hook means and windlass means, each independently adapted for engaging said material and for locating said material in said path.

* * * * *